United States Patent [19]

Adami née Michelini et al.

[11] Patent Number: 4,490,085

[45] Date of Patent: Dec. 25, 1984

[54] VEHICLE HOISTING DEVICE PARTICULARLY FOR USE IN GARAGES

[75] Inventors: Giuseppina Adami née Michelini, Volta Mantovana; Giuseppe Zoccatelli, Goito-Cerlongo, both of Italy

[73] Assignee: A.F.G. S.R.L., Volta Mantovana, Italy

[21] Appl. No.: 310,937

[22] Filed: Oct. 13, 1981

[30] Foreign Application Priority Data

| | | | |
|---|---|---|---|
| Oct. 16, 1980 | [IT] | Italy | 18121 A/80 |
| Feb. 27, 1981 | [IT] | Italy | 19610/81[U] |
| Mar. 31, 1981 | [IT] | Italy | 18106 A/81 |
| Jun. 4, 1981 | [IT] | Italy | 19627/81[U] |
| Sep. 10, 1981 | [IT] | Italy | 18122 A/81 |

[51] Int. Cl.[3] ..... E04H 6/12

[52] U.S. Cl. ..... 414/229; 92/27; 187/8.49

[58] Field of Search ..... 414/227-230, 414/258, 678; 187/8.47, 8.49, 8.52, 8.71, 8.77; 91/443; 92/13.8, 24, 27, 28

[56] References Cited

U.S. PATENT DOCUMENTS

| | | | |
|---|---|---|---|
| 2,554,930 | 5/1951 | Ulinski | 91/443 X |
| 3,804,206 | 4/1974 | Bubik | 187/8.52 |

FOREIGN PATENT DOCUMENTS

| | | | |
|---|---|---|---|
| 1434685 | 10/1968 | Fed. Rep. of Germany | 414/229 |

*Primary Examiner*—Robert G. Sheridan

*Attorney, Agent, or Firm*—Guido Modiano; Albert Josif

[57] ABSTRACT

The hoisting device comprises two ramps rigidly connected, intended to support at least one of the wheel pairs of the vehicle to be hoisted and including a single acting hydraulic cylinder operative to rotate the ramps upwardly from the position with the free end thereof resting on the floor. The ramps are pivoted at one end thereof at a selected level to two floor engaging side plates and a hydraulic system is provided for pivoting the ramps which cooperates with a safety mechanism against the unintentional lowering of the ramps.

6 Claims, 10 Drawing Figures

VEHICLE HOISTING DEVICE PARTICULARLY FOR USE IN GARAGES

BACKGROUND OF THE INVENTION

This invention relates to a vehicle hoisting device, particularly for use in garages.

It is known that a basic problem with garages is the limited availability of space; fairly frequent is in fact the instance of customers who, owning a medium size car and a compact one, only succeed to accommodate the former into the garage, perhaps with some space left, but are obliged to park the other car in the open air.

In an attempt to provide full exploitation of the available space, apparatus have been proposed which had tiltable ramps arranged to receive a car thereon while resting on the floor with one end, to then perform a rotational movement about a pivot pin causing the raising of the car and leaving a space portion available for occupation by a second car.

However, all of the known devices have several disadvantageous features, such as the excessive bulk of the ramp supporting structures, which generally result in a reduced usefulness of the device, prevent its installation in small size garages, and aggravate the cost.

Moreover, conventional devices tend to be of complex design, both as relates to the ram actuation hydraulic system which comprises driven valves and distributors, and to the safety provisions against an unintentional descent of the ramps, with attendant difficulties of operation by the customers and above all total lack of the absolute degree of reliability which is evidently so necessary.

SUMMARY OF THE INVENTION

Thus the task of the present invention is to provide a vehicle hoisting device, particularly for use in garages, with optimized constructional and functional characteristics, owing to the provision of floor engaging means of minimized bulk and suitable for use in all types of garages and also for installation on either finished floors or floors still under construction, as well as of automatic valving means effective to simplify the hydraulic system and cooperate with such safety means, which ensure per se the utmost degree of reliability.

This task is achieved by a vehicle hoisting device particularly for use in garages, according to the invention, comprising two ramps rigidly connected and intended to support at least one of the wheel pairs carried on one axle of a vehicle and having at least one single-acting hydraulic cylinder operative to cause their rotation up from the position with the free end resting on the floor, characterized in that it comprises floor engaging means having structural formations for pivotally supporting said ramps substantially near one end thereof and automatic distributing valve means located in the hydraulic system and cooperating with safety means against the unintentional lowering of the ramps.

BRIEF DESCRIPTION OF THE DRAWINGS

Further features and advantages will be more clearly apparent from the following description of preferred embodiments of the invention, illustrated by way of example and not of limitation in the accompanying drawings, where.

DESCRIPTION OF THE PREFERRED EMBODIMENTS

Figure 1:
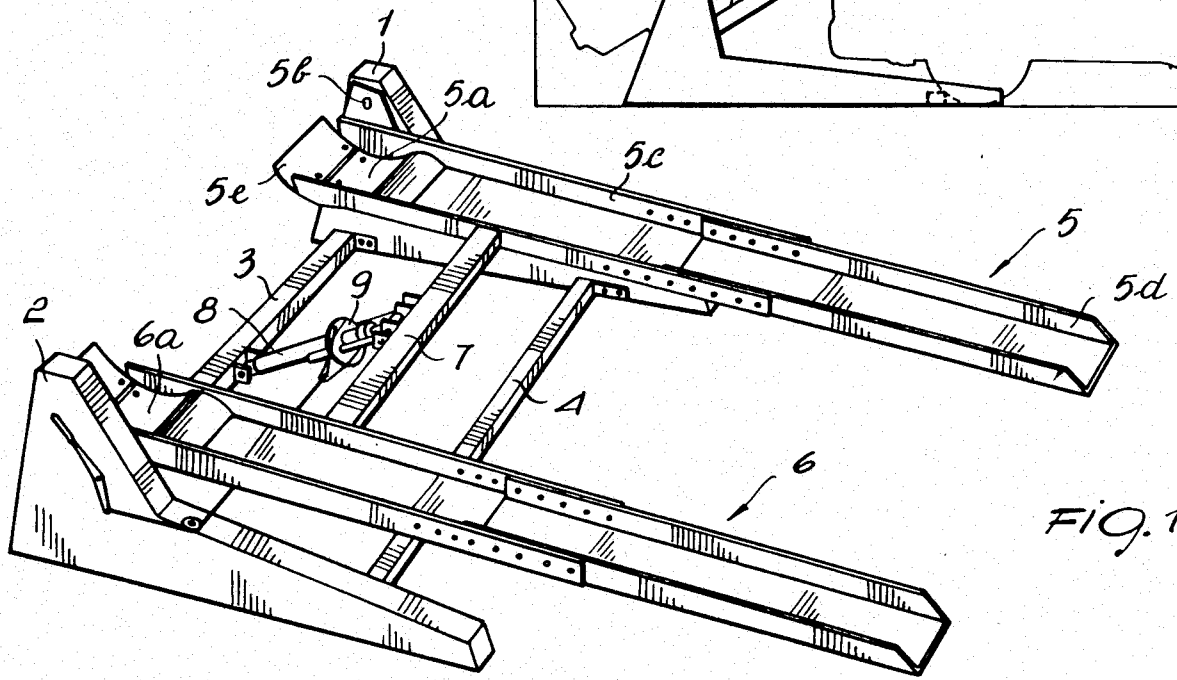
FIG. 1 is a perspective view of a first embodiment of the invention, suitable for installation on finished floors.

With reference to FIG. 1, the device floor engaging means comprise two side members 1 and 2 interconnected by removably attached crosspieces the rear one whereof is indicated at 3 and the front one at 4; the latter can be locked in an adjustable positiion at the floor such as to constitute a detent element for the front wheels of the vehicle intended to arrange itself at the space portion under the raised ramps.

The ramps 5 and 6 on which the vehicle is to climb which must be raised up are rigidly connected by the crosspiece 7 and have at the end at the pivot area the concave portions 5*a* and 6*a* which are shaped with a radius substantially coinciding with the maximum one to be found on vehicle wheels, and hingedly connected to the side members 1 and 2 through pivot pins such as 5*b* for the ramp 5, located at positions substantially coinciding with the center of curvature of said concave portions.

The two ramps are of identical configuration, and it may be seen that the ramp 5 comprises a first segment 5*c* including the concave region 5*a* at its end, and a second segment 5*d* removably attachable to the first at a longitudinally adjustable position, thereby the device can be ideally adapted to fit the type of vehicle and size of the garage; for the same purpose, the concave metal sheet 5*e* removably attachable to the concave region 5*a* is provided. The vehicle to be raised will thus be driven up the ramps 5 and 6 positioned with their ends resting onto the floor, until one pair of wheels, preferably the rear ones, are brought to seat in the concave portions 5*a* and 6*a*, thereafter the ramps will be rotated upwards until the final desired position is reached as determined by a limit switch, through the actuation of the hydraulic cylinder 8 of the single-acting type which is pivoted to the fixed crosspiece 3 and with the piston active on the crosspiece 7, under control from a hydraulic unit, not shown, comprising an electric pump, an oil reservoir, a pressure accumulator, and automatic valving means, as will be explained hereinafter with reference to FIGS. 8 and 9.

Said cylinder 8 is provided, in the space portion above the top face of the piston, with a sufficient amount of oil to stop the movement thereof in the event of failure of the limit switch.

Figure 10:
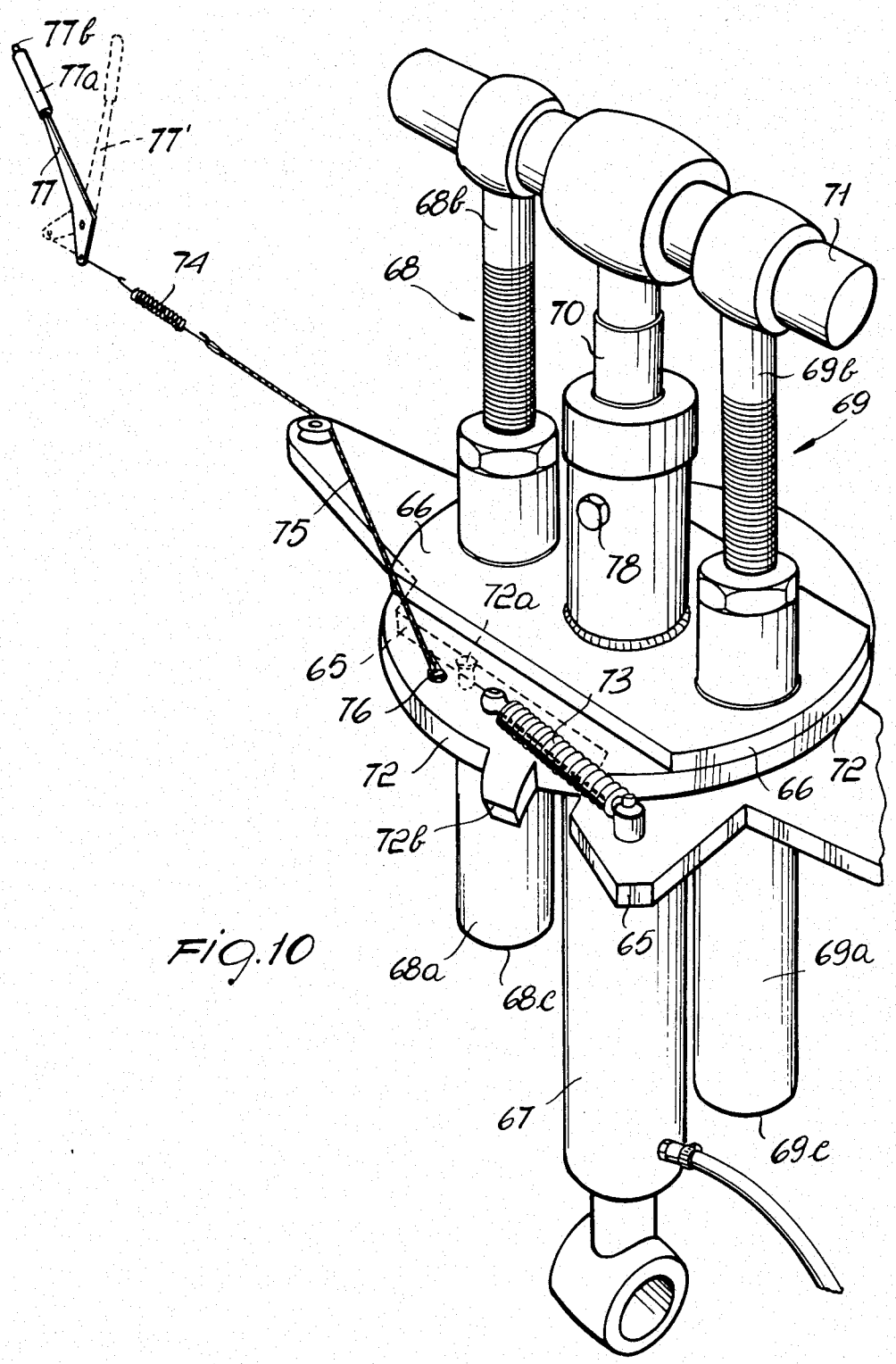
FIG. 10 is a perspective view of the safety means against the unwanted descent of the ramps illustratively shown in FIGS. 1 and 3, some parts being shown in ghost lines, at one instant of the piston rod extension movement, in dotted lines there being also shown the limit position of the lever opposite the one shown in full lines.

Finally, there is illustratively shown, and designated with the numeral 9, a safety device against the unwanted lowering or descent of the ramps which is actuated through the lever connected to the side member 2; this device will be discussed in detail hereinafter with reference to FIG. 10.

Figure 2:
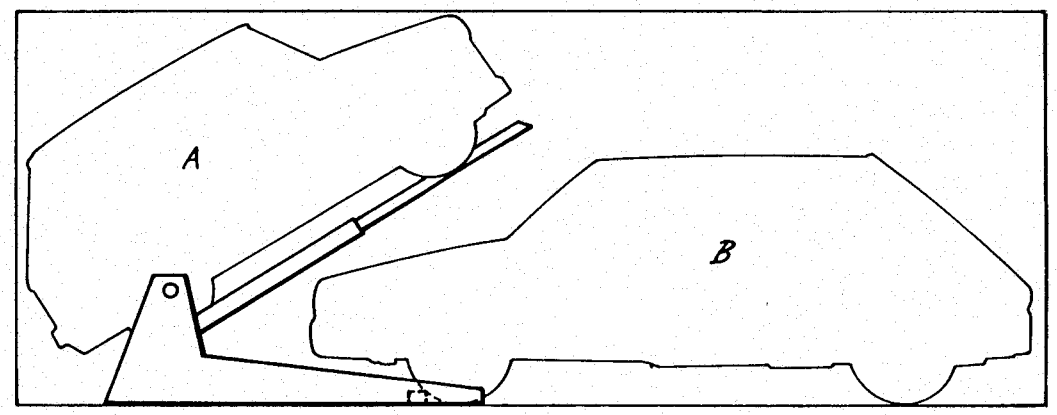
FIG. 2 shows, with the same scale, the outlines of two cars accommodated inside a garage equipped with the device.

The use of the invention is self-evident; however, the Applicant has selected to show in FIG. 2, drawn to scale, by way of example only, the outline of a garage 5.60 m long and 2.30 m high, wherein the invention is placed at the opposite end to the garage gate end; after raising with it in the manner shown in FIG. 2 a FIAT 126 car indicated at B, it becomes possible to also introduce in the garage a FIAT "RITMO" car indicated at A, which thing would be otherwise impossible without this device.

Figure 4:
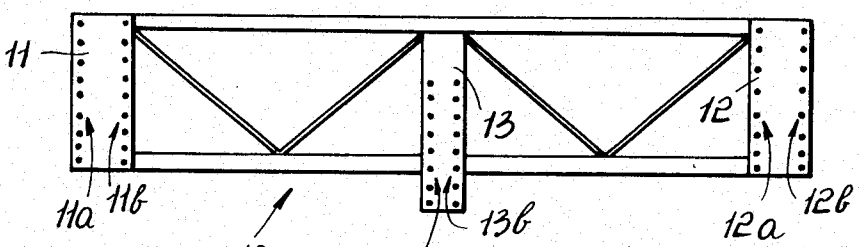
FIG. 4 is a top view of the frame utilized in the modification of the preceding figure.
Figure 3:
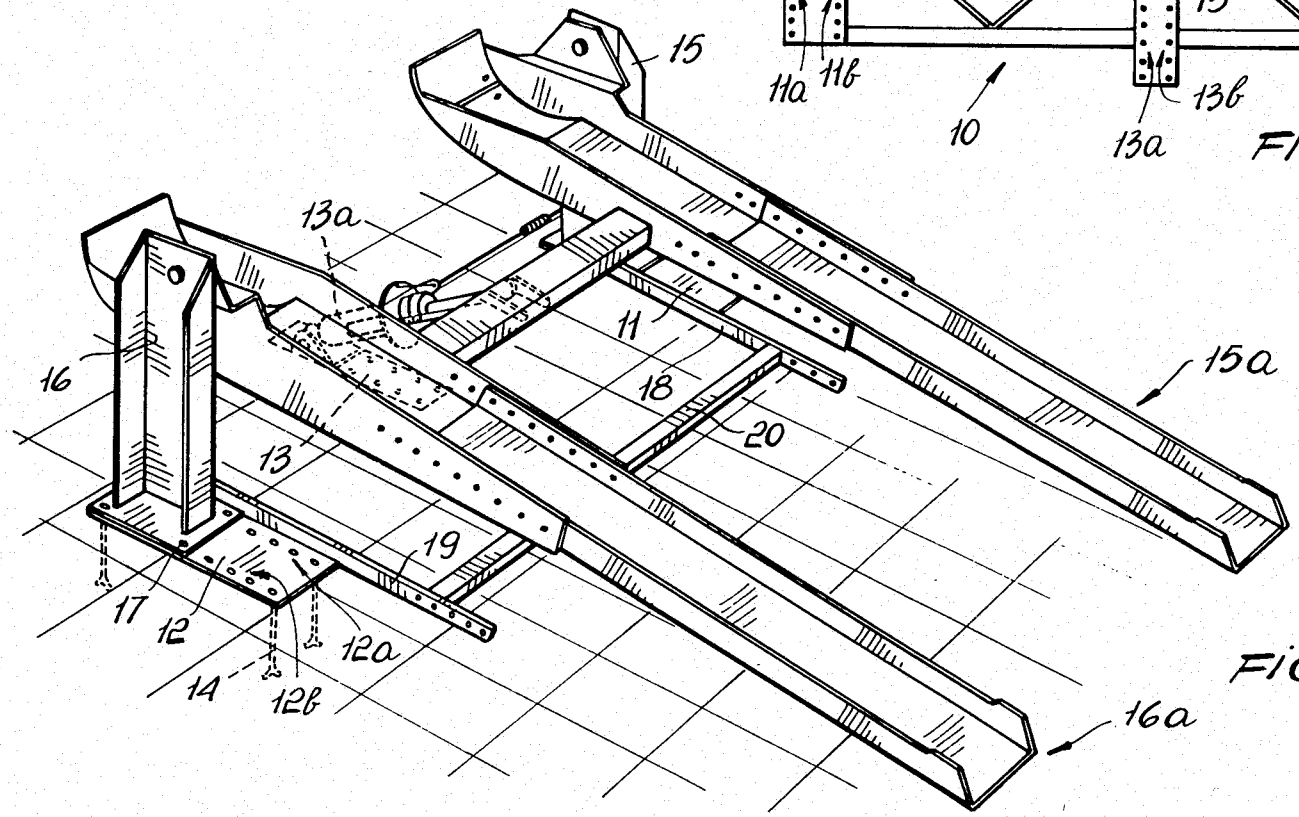
FIG. 3 is a perspective view of a first modification of the floor engaging means, suitable for installation on floors still under construction.

The floor engaging means comprising the side members 1 and 2 lend themselves for installation on finished floors; where the garage is still under construction, said means, shown in FIGS. 3 and 4, would comprise the frame 10 having, at the ends, plates 11 and 12 and, at the middle, a plate 13, all of which extend coplanarly, which is intended for insertion into the garage floor with the top surfaces of said plates flush with the floor surface, as shown in FIG. 3, and secured therein by means of anchoring means such as the lag bolts indicated at 14 incorporated to it. To the plates 11 and 12, there are removably attached the uprights 15 and 16 whereto are pivoted the ramps 15*a* and 16*a* of the device of the type already described with reference to FIG. 1; this fastening is implemented by screws, such as 17, which are inserted through threaded holes suitably selected among those included in the rows 11*a*, 11*b* and 12*a*, 12*b*, respectively on the plates 11 and 12, such as to position said uprights to suit the type of vehicle to be raised.

Similarly to the uprights, to the plate 13 will be also secured the hydraulic cylinder 13*a* operating the ramps and related safety device, by means of screws inserted through suitably selected holes among those of the rows 13*a*, 13*b*; it will be apparent how, where multiple cylinders are provided, the frame 10 would be equipped with a number of intermediate attachment plates.

With the uprights 15 and 16 are removably associated the rods 18 and 19 adapted for supporting in an adjustable position at the floor the cross-piece 20 abutting the wheels of the vehicle to be placed under the ramps.

Figure 5:
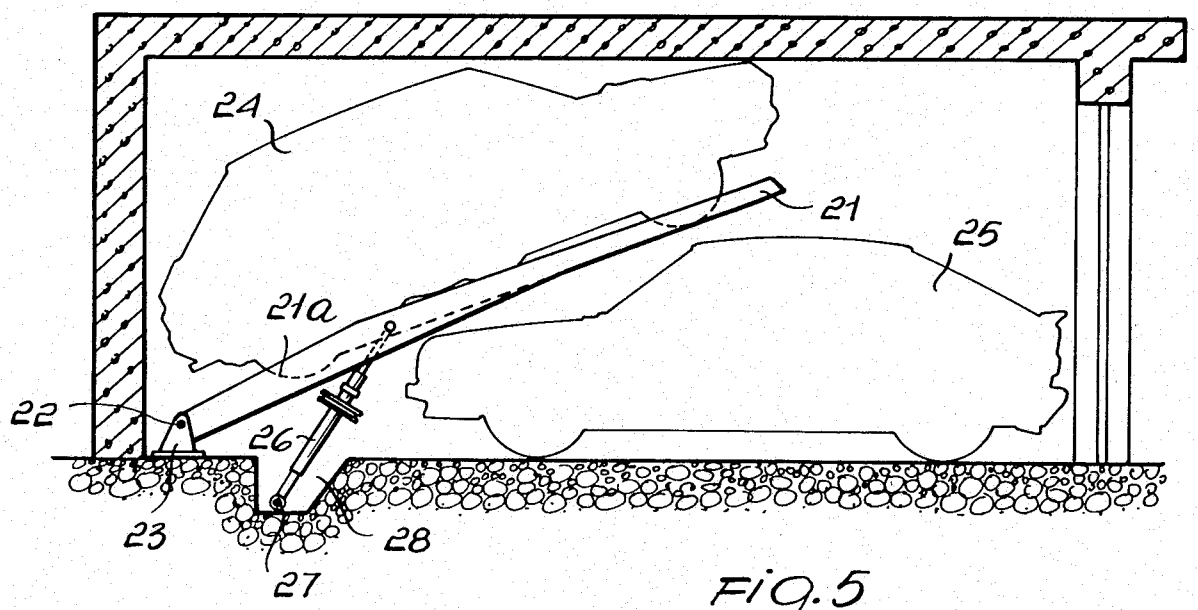
FIG. 5 shows schematically the second embodiment of the invention as provided for installation in low-ceiling garages.

The resting or floor engaging means shown in FIGS. 3 and 4 afford thus a supporting structure which, thanks to the inset effect into the floor, can have a minimal bulk and be very light, with considerable advantages of accessibility to the garage and cost reduction.

Where the device must be installed in very low ceiling garages, the modification of the device shown in FIG. 5 may be adopted; there is shown in the latter, as indicated at 21, one of the device ramps pivoted at 22 to the upright 23, which may be attached to a frame embedded into the floor, not shown in the figure; the height above the floor of the pivot pin 22 is such that, in the fully lowered position, the ramp takes a substantially horizontal lay, to thus make the climbing of the vehicle thereon most easily carried out, while in the fully raised position even the topmost parts of the raised vehicle 24 reach a relatively low height level, without prejudice for the comfortable accomodation of a car 25.

At 26 is indicated the hydraulic lift cylinder, which is pivoted at 27 to the bottom of a pit 28 formed in the floor and provided with the safety device. The ramp 1, and of course the other ramp extending parallel thereto, has a bottom shaped cradle-like at a region 21*a* for receiving the vehicle wheel therein.

Figure 6:
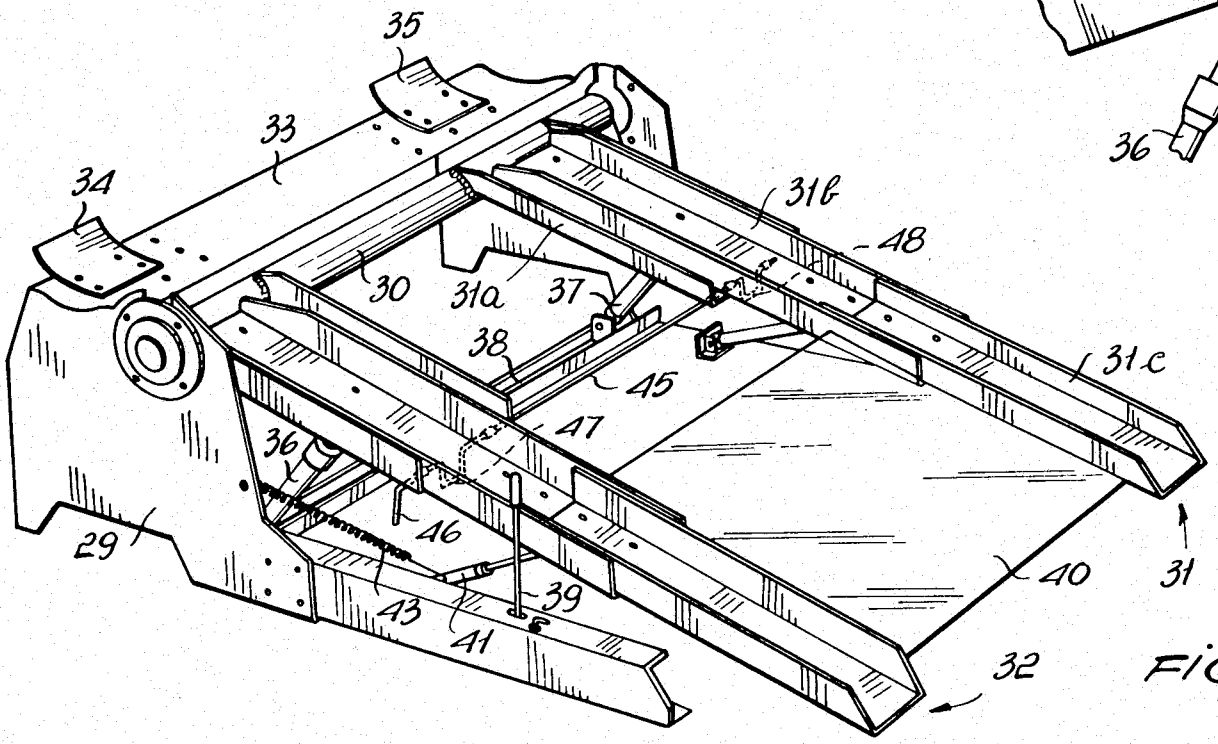
FIG. 6 is a perspective view of a third embodiment of the floor engaging means, provided with safety means against the unintentional lowering of the ramps, according to a further modification of the means shown by way of example in FIGS. 1 and 3.

FIG. 6 shows another embodiment of the device; indicated at 29 therein is the fixed floor engaging structure which carries the tube 30 constituting the pivot pin for the two ramps, generally indicated at 31 and 32, intended to receive the wheels of the vehicle to be raised in the manner to be explained hereinafter.

The ramps 31 and 32 identically comprise three segments each, thereby the ramp 31 is composed of a first segment, indicated at 31*a*, rigidly attached to the tube 30, a second segment, indicated at 31*b* and removably attached to the first at a transversely adjustable position, and a third segment, indicated at 31*c*, which is removably attached to the second at a longitudinally adjustable position.

The floor engaging structure 29 comprises the concave portion 33 at the area directly contiguous to the pivot 30, adapted to provide support for one of the wheel pairs carried on one axle of a vehicle, said support being made more dependable by the provision of the arcuate metal sheet portions 34 and 35 removably attached by means of bolts to said portion 33 at the ramps 31 and 32.

The ramps 31 and 32 are raised from their position with the free end resting on the floor, after a car has been driven up the ramps until one wheel pair engage the concave portion 33 and the other pair reach an area of the ramps which will depend on the length of said car, by the hydraulic cylinders 36 and 37 pivoted to the crosspiece 38 of the structure 29, the actuating circuit whereof comprises, additionally to conventional safety arrangements not shown in the figure and to an optional pressure accumulator, a pump operated manually through the lever 39, the oil reservoir for the system comprising the tube 30.

A plastic sheet stretched between the ramps is indicated at 40.

Figure 7:
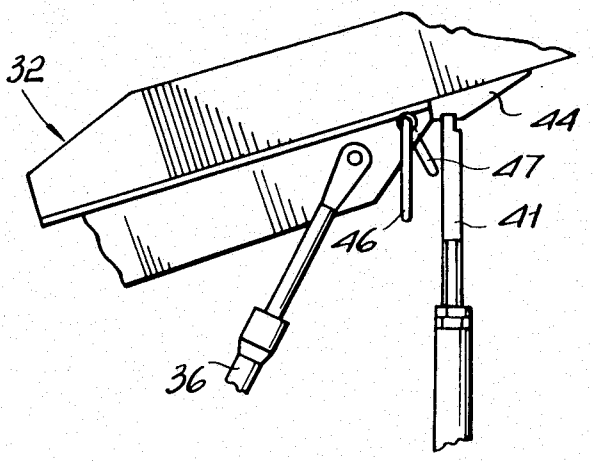
FIG. 7 is a detail view of the safety means of FIG. 6.

The assembly comprising the ramps 31 and 32 is equipped with a safety device against the unwanted lowering or descent of the ramps which constitutes a modification with respect to the one exemplarly shown in FIGS. 1,3 and 5, and will be described with reference to FIG. 10; said device comprises the two struts indicated at 41 and 42 which are pivoted to the structure 29 at the bottom thereof, their top ends being held by the action of springs such as 43 for the strut 41 in constant contact with the bottom side of the ramps during the upward movement thereof, until they contact, upon reaching the position of desired height shown in FIG. 7, a tooth such as 44 for the strut 41, so configured as to inhibit that undesired movement of the ramps.

The safety device further comprises the small shaft 45 which is operated manually through the handle 46 and has two crank levers 47 and 48 adapted to urge the struts with their ends toward the front region of the ramps after said ends have been released from the tooth such as 44 following a slight upward movement of the ramps, thus allowing the ramps to subsequently move down when the vehicle is to be lowered to the floor.

A description will be presently given, with reference to FIGS. 8 and 9, of the hydraulic system for actuating the single-acting cylinder or ram effecting the raising of the ramps, and in particular of the automatic distributor valve included therein, it being understood that nothing will change where multiple cylinders are provided instead of one; the system may also include, as mentioned hereinabove, a pressure accumulator, not shown for brevity in the diagram of FIG. 8.

Figure 8:
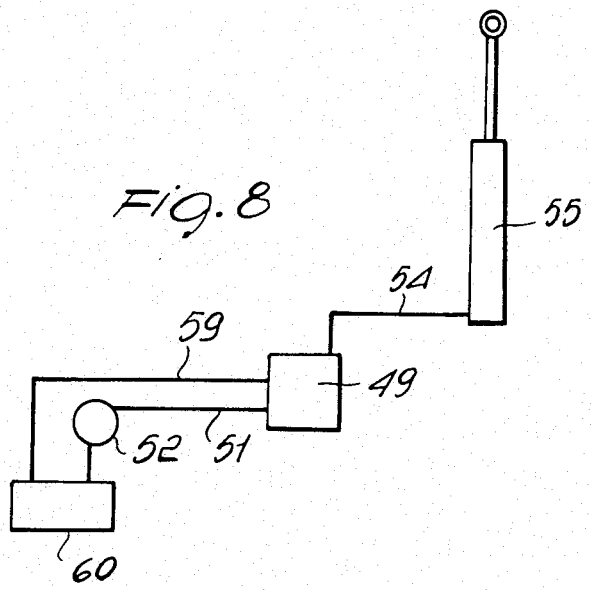
FIG. 8 is a circuit diagram of the hydraulic system for actuating the cylinder or ram.
Figure 9:
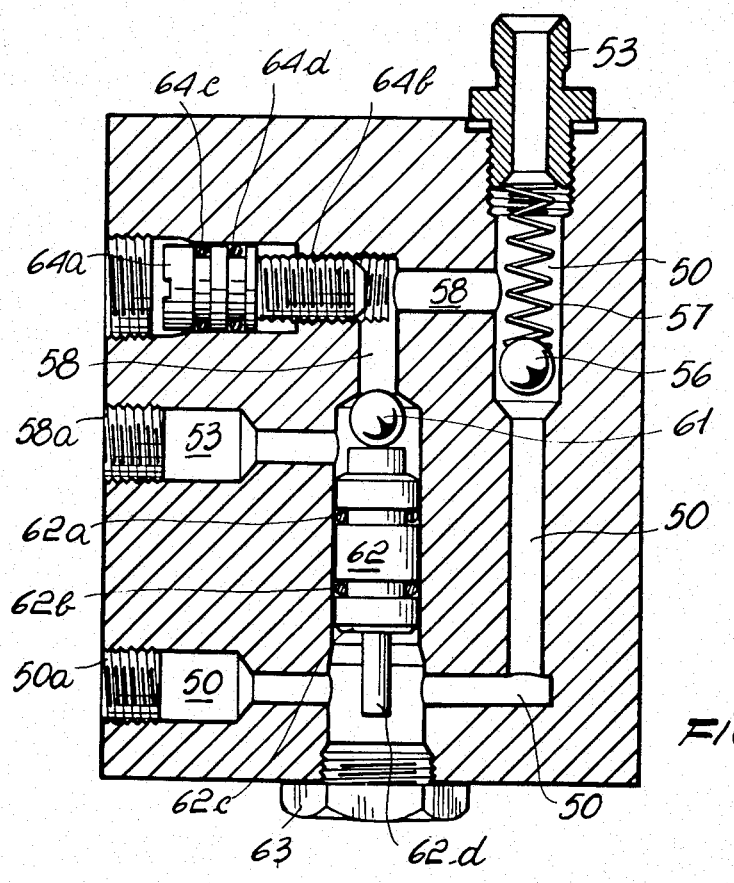
FIG. 9 is a sectional view of the valve included in the hydraulic system during the operation of the pump which supplies oil to the cylinder.

In said FIGS. 8 and 9, there is generally indicated at 49 the valve the body whereof comprises the conduit 50 which is connected with the end 50*a* to the delivery pipe 51 of the pump 52, and with the other end terminates the connector 53 to the pipe 54 which constitutes the connection to the single-acting hydraulic cylinder 55.

At an intermediate location on the conduit 50, there is provided the device checking the backflow to the pump which comprises the ball 56 biased by the spring 57 against its seat. The numeral 58 designates then a second conduit which is connected with its end 58*a* to the discharge pipe 59 leading to the oil reservoir 60 and opens at the other end into the portion of the conduit 50 which is included between the connector 53 and check device.

On the conduit 58 is provided the sliding cut-off member comprising the ball 61, adapted to contact the seat specially formed on the conduit 58, and the slider 62, with sealing rings 62*a* and 62*b*, in communication on the bottom side or face 62*c*, of larger surface area than the sealing seat of the ball 61 on the conduit 58, to the portion of the conduit 50 which is included between the flow checking device and the end 50*a*; the slider 62 is formed with the lug 62*d* adapted to contact, at the lower stroke limit, the plug 63 which plugs the sliding movement seat of the slider 62, without interfering with the flow of oil through the conduit 50.

The cut-off member, so configured, ensures a perfectly tight seal even in the presence of small misalignments between the conduit 58 and sliding movement seat of the slider 62. On the conduit 58 is also provided the manual cut-off device, useful during the operations of adjustment of the stroke length of the piston of the cylinder 55, that is whenever it is desired to leave out the automatism, comprising the screw formed by the head 64*a* and stem 64*b* and provided with the seal rings 64*c* and 64*d*.

The valve operates as follows: with the pump 52 in operation, the oil enters the conduit 50 from the inlet 50*a*, overcomes the action of the spring 57 as suitably calibrated, and then, while keeping the ball 56 off its seat, flows to the connector 53 and hence into the cylinder 55; the oil pressure acting on the side or face 62*c* of the slider 62, in communication with the conduit 50, generates an upwardly directed force which is greater than that generated by that same pressure downwardly onto the ball 61, in communication with the conduit 58, thanks to the favorable surface area ratio of the surfaces whereto said pressure is being applied, and consequently the ball 61 remains in its position against its seat to cut off the oil flow and prevent the oil from flowing to the discharge: this situation is depicted in FIG. 9.

As the pump is stopped after the piston of the cylinder 55 has reached its top stroke limit, and said piston no longer receiving support from the oil or other contrivances, begins to move downwards, the ball 56 will intercept the passage in the conduit 50 and the ball 61 will move downwards leaving its sealing seat since the slider 62 is no longer urged upwards by the oil pressure, thus resulting in the oil passing through the conduit 58 to the end 58*a* and then into the discharge conduit 59 and into the reservoir 60.

Thus, through a very simple means, a valve has been provided which is fully automatic; the construction of the same is therefore feasible on standard machine tools in a very quick manner, and the operation achieves the highest degree of reliability.

The safety device against the unwanted descent of the ramps, shown by way of example in FIGS. 1, 3 and 4, will be presently described in detail with reference to FIG. 10; in said figure there are indicated at 65 and 66 two plates made rigid with the hydraulic cylinder 67 and being provided with two facing bores each, wherethrough the columns 68 and 69 are arranged to slide, which are rigid with the rod 70 of the piston and of variable length owing to their being formed respectively by the cylinders 68*a* and 69*a* which are coupled by means of threads and related locknut to the stems 68*b* and 69*b* connected to the crosspiece 71 which is rigid with the rod 70.

The possibility of varying the length of the columns enables the free ends 68*c*, 69*c* of the same to always locate themselves, with the rod 70 in its fully extended position, within the bores included in the fixed plate 66, such as not to miss the guide with said bores regardless of the stroke completed by the piston in accordance with the positioning of the limit switch which controls its extension.

Designated with the numeral 72 is then a movable plate included between the fixed plates 65 and 66, which can rotate about the axis of the cylinder 67 between two limit positions, at the first whereof, shown in the figure and defined by the limit switch 72*a* with which it is provided contacting a surface of the plate 65, the two bores formed therein line up or register with the bores of the plates 65 and 66, whereas in the second thereof, defined by the limit switch 72*b* contacting another surface of the plate 65, said bores are out of alignment with the bores of the plates 65 and 66.

The rotation of the plate 72, as will be explained more clearly in describing the operation of the device, occurs in either directions thanks to the opposing actions of two members, the first of which comprises the spring 73, in constant tension, connected with its ends respectively to the plate 72 and fixed plate 65 such as to produce a rotation of the plate 72 toward the position of bore misalignment, and the second of which, adapted to produce rotation in the opposite direction, comprises the spring 74, more powerful than the spring 73, connected with one end to the string 75 attached at 76 to the plate 72 and connected with the other end to the lever 77, of the type of those fitted with a rack which are used for actuating the parking brake of passenger cars, which may be locked in different positions by grasping the handle 77*a* and depressing the button 77*b*; with the lever in its limit position shown in full lines, the spring 74 is relaxed, and is put under tension by moving the lever to the limit position indicated at 77' and shown in dotted lines.

Finally, the numeral 78 designates the plug for introducing oil from above the piston into the cylinder 67 and having, as mentioned above, the function of a stroke limiter.

The description of the operation will assume the position shown in the figure, during the extension of the rod 70 which, when continued to a position proximate the fully extended one, causes the columns 68 and 69 to leave, after the bores in the plate 65, also the bores included in the plate 72, and said plate 72 instantaneously snaps under the action of the spring 73 no longer opposed by the spring 74 which is not under tension toward the position whereat the bores thereon no longer line up with the bores of the fixed plates.

The rod 70 shortly continues to move out until, with the ends 68*c* and 69*c* of the columns still included within the bores provided in the plate 66, it meets its stroke limit, not shown, which controls the stopping of the supply of power fluid, automatically there occurring the discharging of said fluid through the automatic distributor valve in accordance with the previously described procedure and the principle of cooperation between the valving means and safety means according to the invention consequently the rod moves down by a slight distance until the ends 68*c* and 69*c* of the columns, held guided by the bores in the plate 66, abut against the plate 72 they finding no longer, on account of the rotation described above which the same has performed owing to the action of the spring 73, the bores to enter in the same, In this position, the rod remains perfectly secured by the columns 68 and 69 bearing onto the plate 72 which in turn abuts against the plate 65, and is thus inhibited from moving down, unless the weldment fails which secures this plate to the cylinder 67 and which is evidently an event which cannot be taken into consideration owing to the absolute reliability of this junction system after a test has ascertained its efficiency. With the columns bearing against the plate 72, which is inhibited from moving by friction, the operator moves the lever 77 into the position 77', thereby the spring 74 is put under tension. When the rod 70 is to be moved down, it will be sufficient to re-start the pump which delivers the operating fluid into the cylinder 67, with consequent lifting of the rod 70 through the short distance from the stroke end, and release of the plate 72, which is no longer retained, under the influence of the spring 74 which is more powerful than the spring 73 toward the position where the bores therein line up with the ones in the fixed plates; thus, as the rod, after contacting its stroke end limiter, begins to move down, the columns 68 and 699 meet with no further opposition to their descent.

The lifting of the rod 70 through the short distance to the stroke end may be accomplished, in the case of an electric pump and power outage, by means of the pressure accumulator included in the system.

If the operator forgets to bring the lever into the position 77' as the columns 68 and 69 bear onto the plate 72, what happens is simply that the spring 74 is not tensioned and therefore the plate 72 is not released, so that the columns again bear thereon upon the rod beginning to move down; immediately the operator, upon perceiving the occurrence, will remedy to it by moving the lever into the position 77'. With the rod fully lowered, the operator moves the lever back into position 77, thus relaxing the spring 74, so that, as the power fluid supply pump is re-started to lift the rod, the device is in the conditions illustrated in the preamble to the operation description, with but the spring 73 being active. If the operator, in the lowered position of the rod, forgets to bring the lever back into the position 77, what happens is that the spring 74 remains under tension, thereby, as the rod begins to move down, the columns 68 and 69 meet with the bores in the plate 72, which has not been released owing to the influence of the spring 73, still lined up with the bores of the fixed plates; consequently the rod continues to move undesirably down, but the operator will immediately detect it and remedy without delay.

Thus, the safety device just described is of great effectiveness, both on account of its intrinsic strength and simplicity of the component parts, and because any failure of a component with kinematic functions becomes evident upon activating the device, with attendant possibility for the operator to readily arrange for the resetting of correct conditions, it being of no consequence where it occurs during the device period of activity.

Thus, the likelihood is ruled out of creating potentially dangerous situations such as might occur if the piston descent can occur unexpectely at any instant of time of the period when the piston is in its extended position.

It should be noted that the members intended to produce the rotation of the movable plate may comprise operating cylinders or electromagnets. With the features described, the device for raising vehicles achieves general characteristics of high efficiency and convenience of use; in particular these are enhanced by the position of the pivot pin of the ramps configured as shown in FIGS. 1 and 3, which position substantially coincides, as mentioned, with the center of curvature of the concave portions.

The invention as described is susceptible to many modifications and variations, without departing from the scope of the instant inventive concept; thus, as an example, it is possible to provide on each ramp of the type illustrated in FIGS. 1 and 3 a concave sheet metal portion removably attachable to an intermediate region of the ramp to provide support for a wheel pair of a car of particular dimensions such that it is unsuitable to find support in the concave portions provided at the ends of said ramps.

In practicing the invention, all of the details may be replaced with other technically equivalent elements; moreover, the materials used, as well as the shapes and dimensions, may be selected as desired to fit individual requirements.

We claim:

1. A vehicle hoisting device particularly for use in garages, comprising two ramps rigidly connected and intended to support at least one of the wheel pairs carried on one axle of a vehicle and having at least one single-acting hydraulic cylinder operative to cause their rotation up from the position with the free end resting on the floor, floor engaging means having structural formations for pivotally supporting said ramps substantially near one end thereof and automatic distributing valve means located in the hydraulic system and cooperating with safety means against the unintentional lowering of the ramps, wherein the safety means against the unwanted lowering of the ramps comprise two plates made rigid with the cylinder and arranged in normal planes to the axis thereof, having each a plurality of bores in respective facing relationship, and columns rigid with the piston and adapted to slide through said bores and having a length which can be varied as a function of the piston stroke length such that the free end, with the piston at its top stroke limit, is located within the bores formed in the closest plate to the cylinder end wherefrom said piston extends, and in that it further comprises, intervening between the two fixed plates, a third movable plate having an identical plurality of bores, adapted for rotation about the cylinder axis between two end positions whereat the plurality of bores provided therein are respectively lined up and disaligned with the plurality of bores of the fixed plates, there being provided a first constantly active member adapted to produce the rotation of said third plate toward the bore disalignment position, and there being provided a second member activated by manual control and adapted to produce a reverse rotation against the action of the first member.

2. A device according to claim 1, characterized in that the member adapted to produce the rotation of the movable plate toward the end position of disalignment of the bores comprises a first spring attached with one end to said movable plate and with the other end to one of the fixed plates, and that the member adapted to produce reverse rotation comprises a second spring, more powerful than the first, connected with one end to a string extending from said movable plate, and connected with the other end to a lever which can be locked at different positions upon manual control, such as to control the tensioning or relaxing of said second spring.

3. A device according to claim 1, characterized in that the members adapted to produce the rotation of the movable plate in either directions comprise operating cylinders.

4. A device according to claim 1, characterized in that the members intended for producing rotation of the movable plate in either directions comprise electromagnets.

5. A device according to claim 1, characterized by the provision of mechanical stroke limiters adapted for locking the movable plate at the end positions of the stroke thereof.

6. A device according to claim 1, characterized in that each column comprises a threaded stem, connected with the end of the piston rod, and a flat base cylinder coupled, through a locknut, to said threaded stem.

* * * * *